US007008512B2

(12) United States Patent
Rougvie et al.

(10) Patent No.: US 7,008,512 B2
(45) Date of Patent: Mar. 7, 2006

(54) FABRIC WITH THREE VERTICALLY STACKED WEFTS WITH TWINNED FORMING WEFTS

(75) Inventors: David S. Rougvie, Appleton, WI (US); Jeffrey Joseph Collegnon, Combined Locks, WI (US); John LaFond, Appleton, WI (US)

(73) Assignee: Albany International Corp., Albany, NY (US)

( * ) Notice: Subject to any disclaimer, the term of this patent is extended or adjusted under 35 U.S.C. 154(b) by 330 days.

(21) Appl. No.: 10/301,352

(22) Filed: Nov. 21, 2002

(65) Prior Publication Data

US 2004/0099327 A1 May 27, 2004

(51) Int. Cl.
*D21F 1/10* (2006.01)
*D21F 7/08* (2006.01)
*D21F 7/12* (2006.01)

(52) U.S. Cl. ..... 162/348; 162/358.2; 162/900; 162/902; 162/903; 442/193; 442/203; 442/205; 139/383 A; 34/116

(58) Field of Classification Search ..... 162/109–117, 162/205–207, 348, 306, 358.1, 358.2, 361, 162/900–904; 139/383 A, 425 A; 442/203–209, 442/189, 192; 34/116, 123; 8/110, 142
See application file for complete search history.

(56) References Cited

U.S. PATENT DOCUMENTS

| | | | | | |
|---|---|---|---|---|---|
| 2,865,409 | A | * | 12/1958 | Asten | 139/426 R |
| 4,379,735 | A | | 4/1983 | MacBean | |
| 4,554,953 | A | * | 11/1985 | Borel et al. | 139/383 A |
| 4,564,051 | A | | 1/1986 | Odenthal | |
| 4,569,375 | A | * | 2/1986 | Borel | 139/383 A |
| 4,941,514 | A | | 7/1990 | Taipale | |
| 5,025,839 | A | * | 6/1991 | Wright | 139/383 A |
| 5,056,565 | A | * | 10/1991 | Kufferath | 139/383 A |
| 5,164,249 | A | | 11/1992 | Tyler et al. | |
| 5,169,709 | A | | 12/1992 | Fleischer | |
| 5,358,014 | A | * | 10/1994 | Kovar | 139/383 A |
| 5,360,518 | A | * | 11/1994 | McCarthy et al. | 162/358.2 |
| 5,366,798 | A | | 11/1994 | Ostermayer | |
| 5,840,378 | A | | 11/1998 | Nagura et al. | |
| 5,857,498 | A | | 1/1999 | Barreto et al. | |
| 5,944,062 | A | * | 8/1999 | Gampe | 139/383 A |
| 6,112,774 | A | * | 9/2000 | Wilson | 139/383 A |
| 6,207,598 | B1 | * | 3/2001 | Lee et al. | 442/206 |
| 6,240,973 | B1 | * | 6/2001 | Stone et al. | 139/383 A |
| 6,530,398 | B1 | * | 3/2003 | Westerkamp | 139/383 A |
| 6,581,645 | B1 | * | 6/2003 | Johnson et al. | 139/383 A |
| 2004/0094223 | A1 | * | 5/2004 | Johnson et al. | 139/383 A |

FOREIGN PATENT DOCUMENTS

| | | |
|---|---|---|
| EP | 1 195 462 A2 | 4/2002 |
| JP | 6-4953 | 1/1994 |

* cited by examiner

*Primary Examiner*—Eric Hug
(74) *Attorney, Agent, or Firm*—Frommer Lawrence & Haug LLP; Ronald R. Santucci

(57) ABSTRACT

A papermaker's fabric, usable in the forming section of a paper machine, has three layers of cross-machine-direction (CD) wefts. The forming layer wefts are grouped into pairs. This twinning of the top-layer wefts results in non-equal spacing in the forming layer. This spacing imparts a desired non-uniformity in the web-supporting surface, thereby reducing the fabric diagonal problem. One of the top-layer wefts in each pair is vertically stacked with the middle and wear side layer wefts. The other top-layer wefts in each pair are unstacked. This alignment increases the drainage properties of the fabric. The middle layer wefts provide extra stability in the CD.

16 Claims, 2 Drawing Sheets

FABRIC WITH THREE VERTICALLY STACKED WEFTS WITH TWINNED FORMING WEFTS

BACKGROUND OF THE INVENTION

1. Field of the Invention

The present invention relates to the papermaking arts. More specifically, the present invention relates to forming fabrics for the forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The properties of absorbency and strength, softness, and aesthetic appearance are important for many products when used for their intended purpose, particularly when the fibrous cellulosic products are facial or toilet tissue, paper towels, sanitary napkins and diapers.

These products can be produced using a variety of processes. Conventional manufacturing machines include a delivery of the suspension of cellulosic fiber onto one or between two forming fabrics. This partially dewatered sheet is then transferred to a press fabric, which dewaters the sheet further as it transfers the sheet to the surface of a large Yankee dryer. The fully dried sheet is either creped or not as it is removed from the Yankee surface and wound onto rolls for further processing.

An alternative process employs a through air drying (TAD) unit either replacing the press fabric above with another woven fabric which transfers the sheet from the forming fabric to the through air drying fabric. It is this fabric which transfers the sheet to a TAD cylinder where hot air is blown through the wet cellulosic sheet, simultaneously drying the sheet and enhancing sheet bulk and softness.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The design of forming fabrics additionally involves a compromise between the desired fiber support and fabric stability. A fine mesh fabric may provide the desired paper surface and fiber support properties, but such design may lack the desired stability resulting in a short fabric life. By contrast, coarse mesh fabrics provide stability and long life at the expense of fiber support and the potential for marking. To minimize the design tradeoff and optimize both support and stability, multi-layer fabrics were developed. For example, in double and triple layer fabrics, the forming side is designed for support while the wear side is designed for stability.

Those skilled in the art will appreciate that fabrics are created by weaving, and having a weave pattern which repeats in both the warp or machine direction (MD) and the weft or cross-machine direction (CD). It will also be appreciated that the resulting fabric must be uniform in appearance; that is there are no abrupt changes in the weave pattern to result in a mark in the formed paper sheet. Due to the repeating nature of the weave patterns, a common fabric deficiency is a characteristic diagonal in the fabric. To varying degrees, this diagonal is imparted to the paper sheet. Through the use of new weave patterns and smaller diameter monofilaments, this diagonal marking can be masked but cannot be altogether eliminated. It has been theorized that a random surface in a forming fabric would result in a paper sheet that is potentially free of diagonal marking. However, a true random surface is almost impossible to create and by definition any pattern must eventually repeat to avoid an abrupt change in the pattern causing a sheet mark.

One attempt to breakup the surface pattern is shown in U.S. Pat. No. 5,025,839. The '839 patent shows a standard two-layer fabric wherein the MD yarns are interwoven to produce a zigzag effect. However, as stated in U.S. Pat. No. 5,857,498, the shute (weft) twinning promoted by the pattern taught in the '839 patent does not produce favorable drainage properties.

Additionally, several closely related patents exist covering triple stacked shute (TSS) designs; e.g. JP6-4953, U.S. Pat. Nos. 4,379,735, 4,941,514, 5,164,249, 5,169,709 and 5,366,798. While all of these patents describe TSS fabrics, but none have the surface non-uniformity that is deemed to be favorable, especially for use in the production of tissue.

Furthermore, it is desired that multi-layer fabrics have more cross-directional stability and stiffness to prevent cross directional shrinkage, improve sheet formation and appearance, and potentially increase life.

The present invention is a forming fabric with twinned top wefts and an extra layer of middle wefts. The present invention provides a solution to the problems of drainage, sheet fiber support, and fabric stability.

SUMMARY OF THE INVENTION

Accordingly, the present invention is a forming fabric, although it may find application in the forming, pressing and drying sections of a paper machine.

The present invention is a fabric having a desirable non-uniform surface. To address the sheet formation problem and create a desired non-uniform surface, the top-layer or forming side wefts in the present invention are twinned together into pairs. This results in a small open space between the paired wefts and a larger space between adjacent pairs. Thus, the present invention has non-equal spacing between adjacent wefts, whereas prior art fabrics have equal spacing between every adjacent forming side weft.

To provide more cross-directional stability and stiffness, the invention utilizes a third set of wefts, in the middle layer of the fabric, to provide extra stability in the cross direction.

The fabric is a forming fabric having a top layer, a middle layer, and a bottom layer of cross-machine direction (CD) wefts and a system of machine-direction (MD) warp yarns interwoven with the top, middle, and bottom layers of CD wefts. The CD wefts in the top layer are grouped into twinned pairs to produce a non-uniform spacing between wefts in the top layer. The CD wefts in the middle layer provide extra stability in the CD. The CD wefts in the middle layer and bottom layer are vertically stacked with one of the CD wefts in each top layer pair. Thus, the other CD weft in each top layer pair is vertically offset from the stacked middle and bottom layer CD wefts. This stacked alignment improves the drainage properties of the fabric. This increased drainage allows the fabric count to be dramatically increased which leads to improved fiber support.

The shute (weft) twinning in the top surface of this fabric provides for increased CD tensile strength in the sheet of formed tissue paper. This gain in CD tensile allows for other changes in the process to be implement, which result in improved sheet formation, softness, and water absorbency.

In a preferred embodiment, the top layer of CD yarns forms the forming side of the fabric and the bottom layer of CD yarns forms the wear side of the fabric. The fabric is preferably woven with each top-layer CD weft passing over at least two and not more than fifteen adjacent MD yarns. Further, the system of MD yarns may comprise at least two alternating yarns weaving the same pattern offset in the MD.

Other aspects of the present invention include that the non-uniform spacing between wefts in the top layer has a spacing ratio between 1:1.5 and 1:20.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
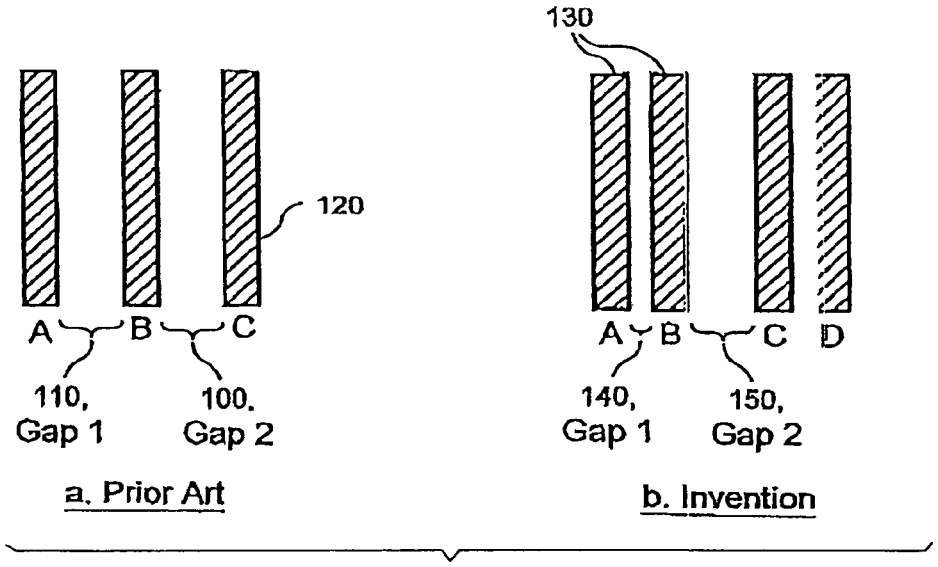
FIG. 1 is a schematic view showing the spacing between forming-side wefts in forming fabrics according to a) the prior art and b) the present invention.

FIG. 1 is a schematic view providing a comparison between the weft/shute spacing in the top (or forming) layer of prior art fabrics and the present invention. Each vertical stripe in the figure represents a forming side weft. FIG. 1*a* shows the weft spacing according to the prior art, while FIG. 1*b* shows the weft spacing according to the present invention. Note that in FIG. 1*a*, the spacing of Gap 1 110 is approximately equal to the spacing of Gap 2 100. Whereas, in FIG. 1*b*, the wefts are unevenly spaced. Because of the uneven spacing between wefts A and B, and B and C; wefts A and B are characterized as twinned, or paired, wefts 130. This twinning/pairing is considered beneficial as the non-uniform spacing helps promote drainage and conceals the diagonal sheet mark.

A sample forming fabric has been produced in accordance with the teachings of the present invention. Measurements taken from this sample fabric show that the forming side wefts 120 have a cross-sectional diameter of 0.165 mm, Gap 1 140 between twinned wefts 130 is only 0.076 mm, and Gap 2 150 between adjacent pairs is 0.114 mm. By contrast, measurements taken from a typical prior art forming fabric, show that the forming side wefts 120 typically have a cross-sectional diameter of 0.165 mm and the spacing between wefts is approximately 0.27 mm. Thus, as indicated by FIG. 1*b*, the gap or spacing between the first pair, A and B is only one-half the size of the spacing between wefts B and C. Thus, this sample fabric according to the present invention has a spacing ratio of 1:2. It is an object of the present invention to cover a range of spacing ratios between 1:1.5 and 1:20.

Figure 2:
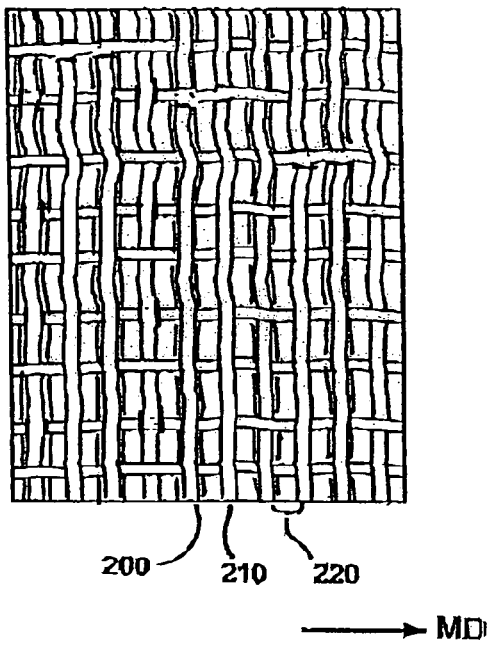
FIG. 2 is a forming side view of a fabric woven in accordance with the teachings of the present invention.

FIG. 2 shows a topside view of the forming side of a fabric according to the teachings of the present invention. In FIG. 2, pairs of top-layer/forming-side wefts 220 are spaced together to form twinned pairs of shutes. One of the CD wefts 200 in each pair is vertically stacked over the middle and bottom layer CD wefts. The other CD weft 210 in each pair is left unstacked. These pairs are spaced apart by a multiple of the distance between the wefts in each pair. The middle layer wefts reside in a lower plane than the top/forming side wefts and are vertically stacked over the wear-side wefts. These middle layer wefts provide cross directional stability and prevent fabric shrinkage in the CD.

Figure 3:
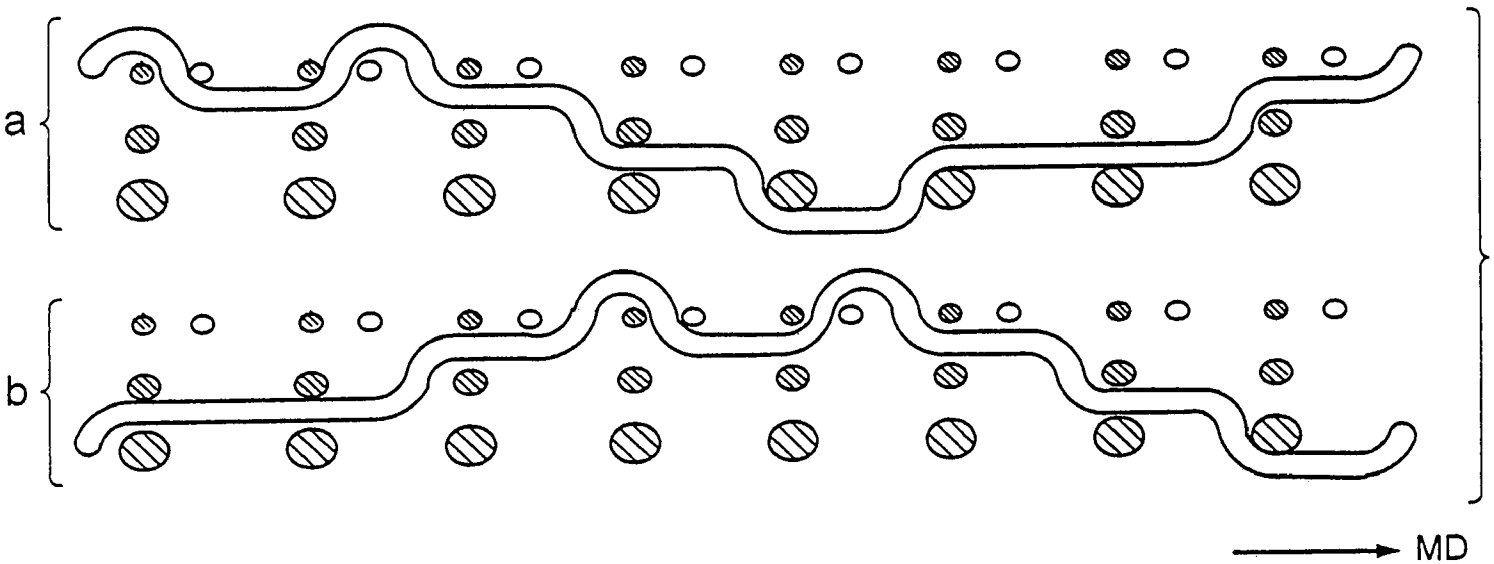
FIG. 3 shows schematic cross-sectional views for two MD yarns in a fabric pattern in accordance with the teachings of the present invention.

FIG. 3 is a schematic cross-sectional view of a fabric pattern in accordance with the teachings of the present invention. FIGS. 3*a* and 3*b* show a weave pattern having two alternating MD yarns which both weave the same pattern but are offset in the MD. As shown in FIG. 3, the middle wefts are stacked directly above the bottom layer (wear side) wefts, while the twinned top layer (forming side) wefts alternate between being vertically stacked and horizontally offset from the stacked middle and wear side wefts. The specific position of the forming, middle, and wear wefts, in relation to each other, helps promote drainage and reduce diagonal sheet marking, both benefits for paper machine applications.

The weave pattern shown in FIG. 3 is simply one embodiment of the present invention. In this embodiment, the forming fabric is woven in an eight-shed 2.5 layer weave pattern, wherein each top-layer CD weft passes over at least two and not more than fifteen adjacent MD yarns. The present invention is not to be limited to this pattern, and in fact encompasses many weave patterns.

Figure 4:
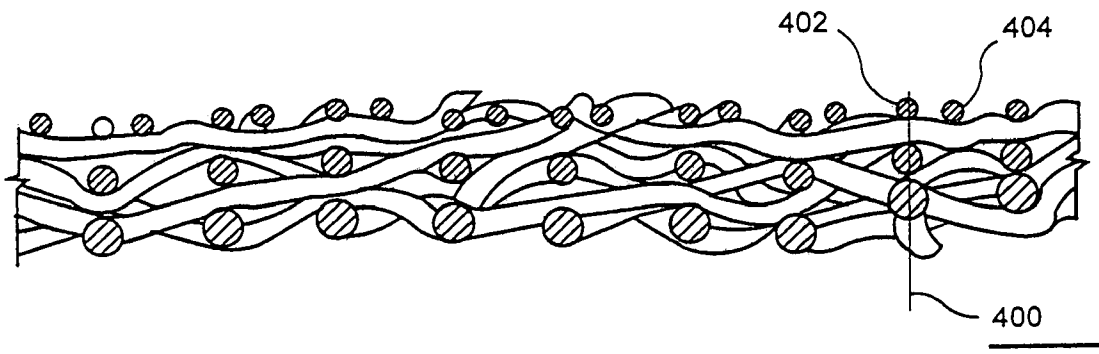
FIG. 4 shows cross-sectional views of a fabric woven in accordance with the teachings of the present invention.

FIG. 4 shows cross-sectional views of a fabric woven in accordance with the teachings of the present invention. The fabric has twinned top-layer (forming side) wefts 402 and 404. Note the spacing between the wefts in a pair is significantly less than the spacing between pairs. As shown by the vertical line 400, one of the top-layer wefts in each pair 402 is stacked with the middle and wear side layers in the vertical direction. Hence, the other top-layer weft in each pair 404 is left unstacked.

The fabric according to the present invention preferably comprises only monofilament yarns. Specifically, the CD yarns may be polyester monofilament and/or some may be polyester and polyamide yarns. The CD and MD yarns may have a circular cross-sectional shape with one or more different diameters. Further, in addition to a circular cross-sectional shape, one or more of the yarns may have other cross-sectional shapes such as a rectangular cross-sectional shape or a non-round cross-sectional shape.

Modifications to the above would be obvious to those of ordinary skill in the art, but would not bring the invention so modified beyond the scope of the present invention. The claims to follow should be construed to cover such situations.

What is claimed is:

1. A papermaker's fabric comprising:

a top layer, a middle layer, and a bottom layer of cross-machine direction (CD) wefts;

a system of machine-direction (MD) yarns interwoven with the top, middle, and bottom layers of CD wefts;

wherein the CD wefts in the top layer are grouped into twinned pairs to produce a non-uniform spacing between wefts in the top layer;

wherein the CD wefts in the middle layer provide extra stability in the CD; and one of the CD wefts in each top-layer pair being vertically stacked with the CD wefts in the middle layer and bottom layer; the other CD weft in each top-layer pair vertically offset from the stacked middle and bottom layer CD wefts, thereby increasing drainage of the fabric.

2. The papermaker's fabric according to claim 1, wherein the top layer of CD yarnsforms a forming side of the fabric and the bottom layer of CD yarnsforms a wear side of the fabric.

3. The papermaker's fabric according to claim 1, wherein the system of MD yarnscomprises at least two alternating yarnsweaving the same pattern offset in the MD.

4. The papermaker's fabric according to claim 1, wherein the MD yarns and CD yarns are monofilament yams.

5. The papermaker's fabric according to claim 1, wherein the fabric is a forming, pressing, drying, or industrial type of fabric.

6. The papermaker's fabric according to claim 1, wherein at least some of the MD warp yarnsare one of polyamide yarns or polyester yams.

7. The papermaker's fabric according to claim 1, wherein at least some of the CD wefts are one of polyamide yarnsor polyester yams.

8. The papermaker's fabric according to claim 1, wherein the MD warp yarnsand CD wefts have a circular cross-sectional shape, a rectangular cross-sectional shape or a non-round cross-sectional shape.

9. A papermaker's fabric comprising:

a top layer, a middle layer, and a bottom layer of cross-machine direction (CD) wefts;

a system of machine-direction (MD) yarnsinterwoven with the top, middle, and bottom layers of CD wefts;

wherein the CD wefts in the top layer are grouped into twinned pairs to produce a non-uniform spacing between wefts in the top layer, and wherein the non-uniform spacing between wefts in the top layer has a spacing ratio between 1:1.5 and 1:20;

wherein the CD wefts in the middle layer provide extra stability in the CD; and one of the CD wefts in each top-layer pair being vertically stacked with the CD wefts in the middle layer and bottom layer; the other CD weft in each top-layer pair vertically offset from the stacked middle and bottom layer CD wefts, thereby increasing drainage of the fabric.

10. The papermaker's fabric according to claim 9, wherein the top layer of CD yarnsforms a forming side of the fabric and the bottom layer of CD yarns forms a wear side of the fabric.

11. The papermaker's fabric according to claim 9, wherein the system of MD yarnscomprises at least two alternating yarns weaving the same pattern offset in the MD.

12. The papermaker's fabric according to claim 9, wherein the MD yarnsand CD yarnsare monofilament yams.

13. The papermaker's fabric according to claim 9, wherein the fabric is a forming, pressing, drying, or industrial type of fabric.

14. The papermaker's fabric according to claim 9, wherein at least some of the MD warp yarnsare one of polyamide yarnsor polyester yams.

15. The papermaker's fabric according to claim 9, wherein at least some of the CD wefts are one of polyamide yarnsor polyester yams.

16. The papermaker's fabric according to claim 9, wherein the MD warp yarnsand CD wefts have a circular cross-sectional shape, a rectangular cross-sectional shape or a non-round cross-sectional shape.

* * * * *